US006634031B1

(12) United States Patent
Schlapkohl

(10) Patent No.: US 6,634,031 B1
(45) Date of Patent: Oct. 21, 2003

(54) CAP MOUNTED LIGHT

(76) Inventor: Thomas P. Schlapkohl, 13908 Buena Vista Dr., Urbandale, IA (US) 50323

( * ) Notice: Subject to any disclaimer, the term of this patent is extended or adjusted under 35 U.S.C. 154(b) by 0 days.

(21) Appl. No.: 10/173,499

(22) Filed: Jun. 17, 2002

(51) Int. Cl.[7] ..... A42B 1/24
(52) U.S. Cl. ..... 2/209.13; 362/103; 362/802
(58) Field of Search ..... 2/209.13, 195.1, 2/195.2, 905, 195.4, 906; 362/103, 105, 106, 190, 191, 427, 800, 802

(56) References Cited

U.S. PATENT DOCUMENTS

| | | | | |
|---|---|---|---|---|
| 2,943,186 A | | 6/1960 | Weiss | |
| 4,406,040 A | * | 9/1983 | Cannone | 24/3.12 |
| 4,507,716 A | | 3/1985 | Benedict, Jr. | |
| 4,530,112 A | * | 7/1985 | Cecala et al. | 362/107 |
| 4,878,107 A | | 10/1989 | Hopper | |
| 4,916,596 A | * | 4/1990 | Sharrah et al. | 362/190 |
| 4,945,458 A | | 7/1990 | Batts et al. | |
| 4,998,187 A | * | 3/1991 | Herrick | 362/103 |
| 5,018,057 A | | 5/1991 | Biggs et al. | |
| 5,363,291 A | | 11/1994 | Steiner | |
| 5,485,358 A | * | 1/1996 | Chien | 362/106 |
| 5,541,816 A | * | 7/1996 | Miserendino | 362/106 |
| 5,658,065 A | | 8/1997 | Jamieson | |
| 5,680,718 A | | 10/1997 | Ratcliffe et al. | |
| 5,741,060 A | | 4/1998 | Johnson | |
| 6,168,286 B1 | | 1/2001 | Duffy | |

FOREIGN PATENT DOCUMENTS

WO WO 94/13163 6/1994

OTHER PUBLICATIONS

The Sportsman's Guide—Camping catalog p. 49.

* cited by examiner

*Primary Examiner*—John J. Calvert
*Assistant Examiner*—Katherine Moran
(74) *Attorney, Agent, or Firm*—Brett Trout

(57) ABSTRACT

An illumination system for a hat is provided. The system includes a light pivotally connected to an attachment mechanism constructed of hook and latch material. The hook and latch material is provided around an adjustment band of a typical "baseball cap." Batteries and a touch sensitive switch are coupled to the light with the touch sensitive switch facing inward. The cap is usable in its standard orientation during the day to shield the suns rays from the user's eyes. At night, or indoors, the cap may be reversed. Whereas in the standard orientation the touch sensitive switch is blocked from contact with the skin by the user's hair, in the reversed orientation the touch sensitive switch contacts the user's forehead, thereby actuating the light automatically for use.

6 Claims, 8 Drawing Sheets

CAP MOUNTED LIGHT

BACKGROUND OF THE INVENTION

1. Field of the Invention

The present invention relates in general to an illumination system for a hat and, more specifically, an illumination system for a hat with an automatic touch sensitive activation switch which automatically actuates a light upon reversal of the hat.

2. Description of the Prior Art

Illuminated hats are well known in the art. Typically, such devices include forward directed lights such as those described in U.S. Pat. No. 5,714,060, or devices used to illuminate the hat itself, such as that described in U.S. Pat. No. 6,168,286. The devices are typically actuated by a mechanical switch or the like.

A drawback associated with such prior art devices is the difficulty locating and actuating what are typically micro switches. An additional drawback is the bulk, weight and aesthetically displeasing appearance of light assemblies attached to the brim or front of a baseball cap. Another drawback associated with such prior art devices is the obstructive positioning of the sun visor when the apparatus is being used indoors or at night to illuminate a poorly lit object.

It would, therefore, be desirable to provide a device which actuated automatically, which was aesthetically pleasing, and which did not add bulk or weight to the front of a baseball cap. It would be additionally desirable to provide a system which did not cause the sun visor to obstruct viewing at night or indoors when the apparatus was used to illuminate objects. The difficulties encountered in the prior art discussed hereinabove are substantially eliminated by the present invention.

SUMMARY OF THE INVENTION

In an advantage provided by this invention, a hat illumination assembly actuates without the need for digital manipulation.

Advantageously, this invention provides a low-cost, lightweight hat illumination assembly.

Advantageously, this invention provides a hat illumination assembly which may be quickly secured to or released from a hat.

Advantageously, this invention provides a hat illumination assembly-which is aesthetically pleasing and which does not add weight or bulk to the front of hat.

Advantageously, this invention provides a hat illumination assembly which eliminates visual obstruction caused by a sun visor when the illumination assembly is being used indoors or at night to illuminate an object.

Advantageously, in the preferred example of this invention, a hat illumination assembly is provided comprising a light, means for securing the light to a hat, and a touch sensitive switch and power source coupled to the light. In the preferred embodiment, the light is releasably secured to an adjustment band of a baseball cap with a hook and latch material. The hat is designed to actuate automatically when the baseball cap is reversed, thereby allowing the touch sensitive switch to contact the user's forehead.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
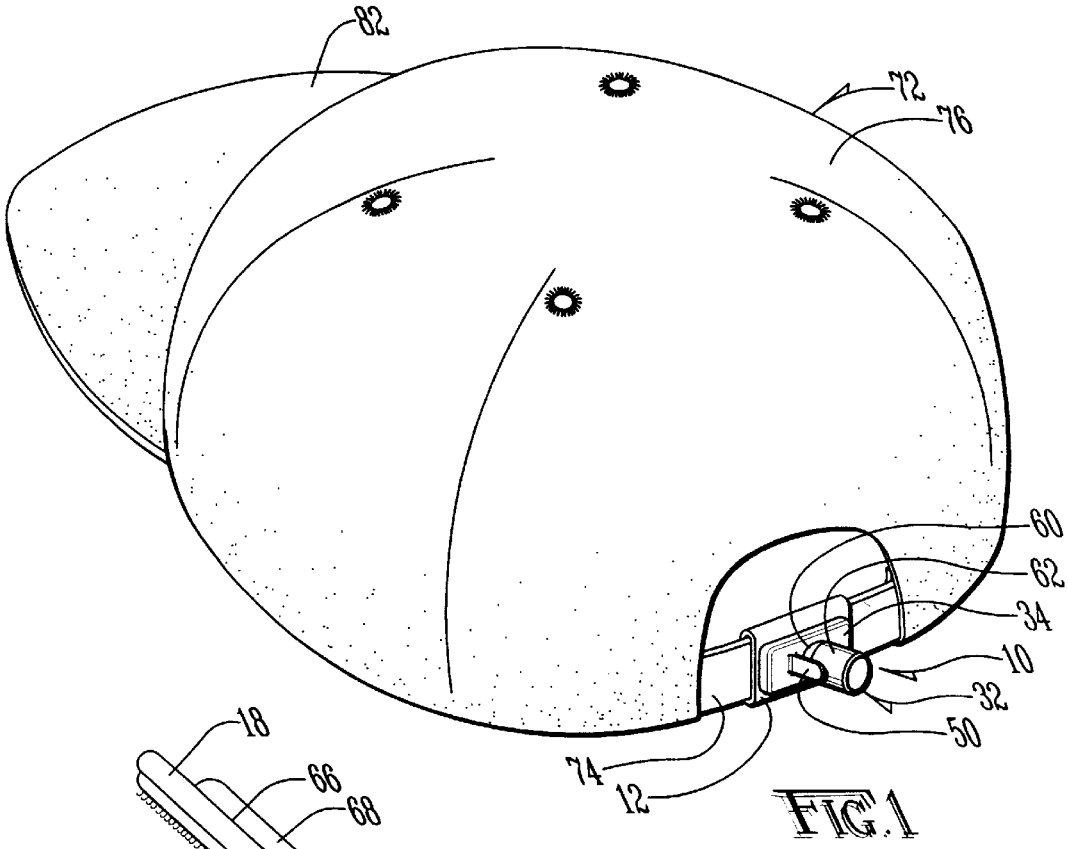
FIG. 1 illustrates a rear elevation, shown with the light assembly releasably attached to the adjustment band of a baseball cap.
Figure 2A:
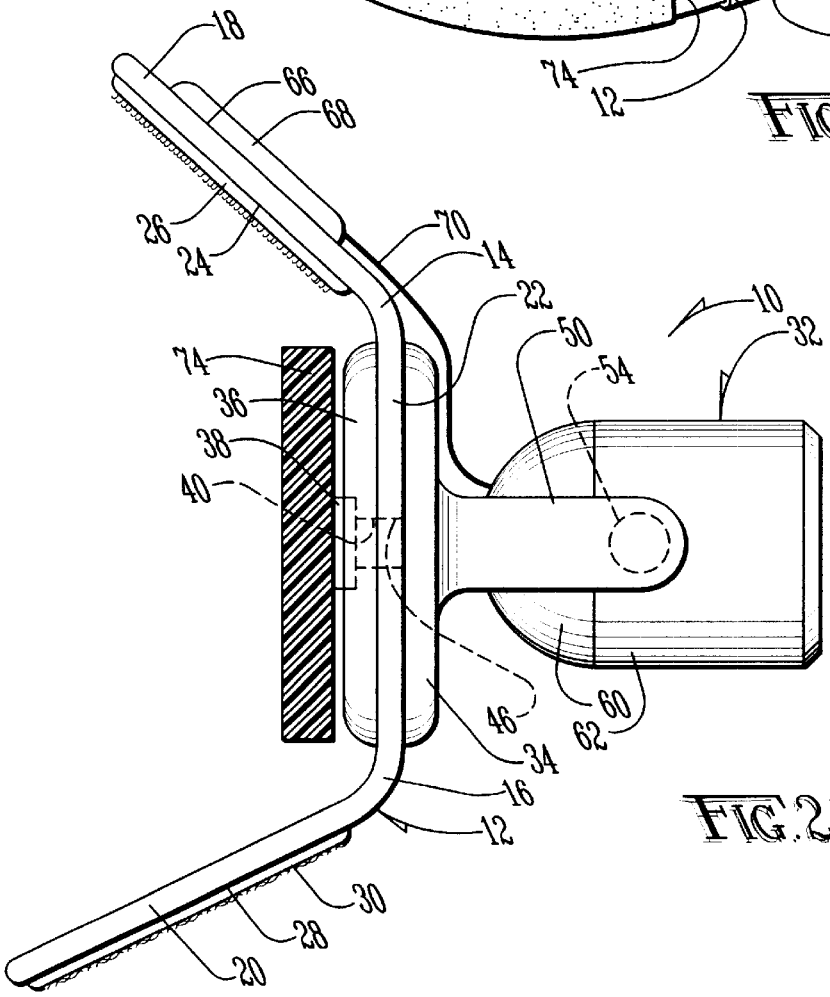
FIG. 2A illustrates a side elevation of the light assembly being provided around the adjustment band.

A cap illumination system according to this invention is shown generally as (10) in FIG. 1. The cap illumination system (10) includes a retaining belt (12) constructed of woven nylon or similar flexible material. (FIG. 2A). Although the retaining belt (12) may be of any suitable dimensions, in the preferred embodiment, the retaining belt (12) is preferably between two and fifty centimeters square and between 0.5 and 5 mm thick. The retaining belt (12) is even more preferably eight centimeters square and two millimeters thick.

As shown in FIG. 2A the retaining belt (12) is preferably provided with a first crease (14) and second crease (16), dividing the retaining belt (12) into a first flap (18), a second flap (20) and a body (22). Secured to an interior face (24) of the first flap (18) by adhesive, sewing, or similar securement means, is a first piece (26) of hook and latch material. Secured to an exterior face (28) of the second flap (20) is a second piece (30) of hook and latch material. Although the pieces (26) and (30) of hook and latch material may be of any suitable dimensions, in the preferred embodiment they are preferably six centimeters wide and two centimeters high.

Figure 2B:
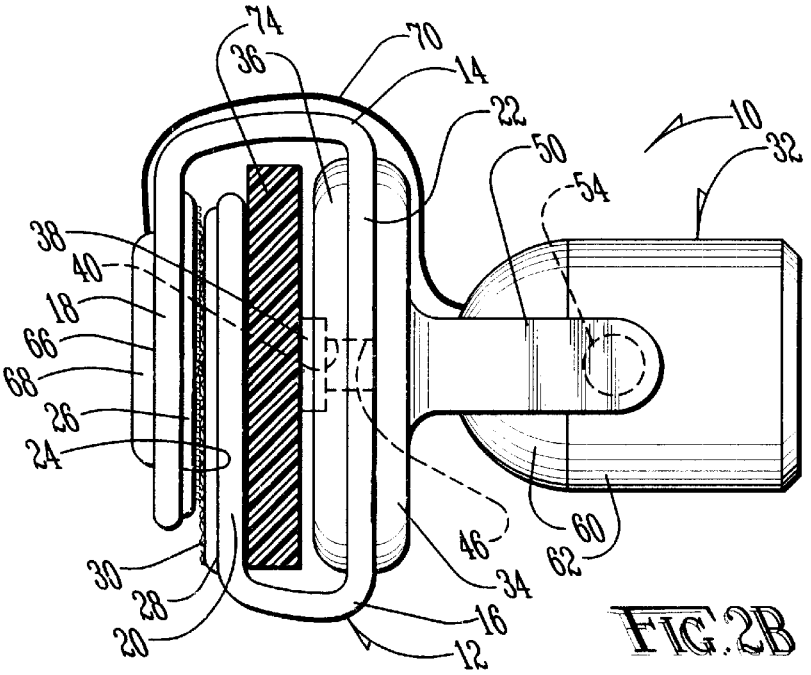
FIG. 2B illustrates a side elevation, showing the light assembly secured to the adjustment band.
Figure 2C:
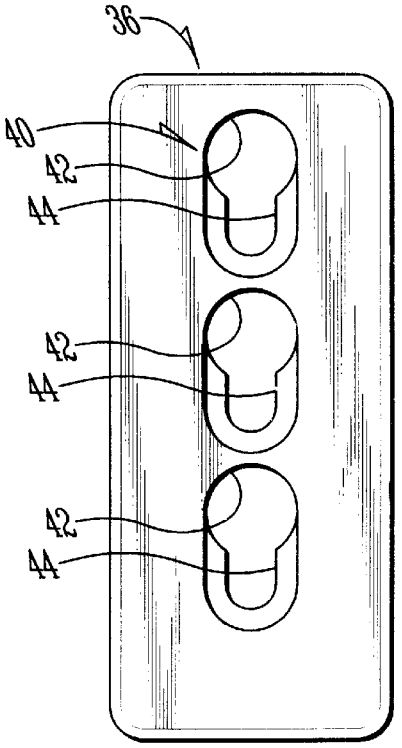
FIG. 2C illustrates a top elevation of the back plate of the light assembly.
Figure 2D:
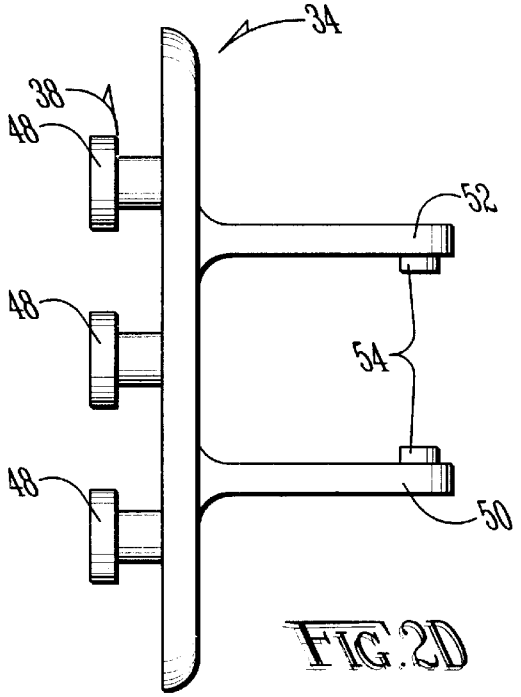
FIG. 2D illustrates a side elevation of the front plate of the light assembly.

Also as shown in FIG. 2A, secured to the body (22) of the retaining belt (12) is a light assembly (32). The light assembly (32) is secured to the retaining belt (12) by a front plate (34) and a back plate (36). Although the front plate (34)

and back plate (36) may be constructed of any suitable material, in the preferred embodiment they are preferably constructed of rigid nylon, plastic or the like. Preferably, the front plate (34) and back plate (36) are each two centimeters high and four centimeters wide. As shown in FIG. 2A, the front plate (34) is integrally molded with a plurality of headed pins (38). The back plate (36) is molded with a plurality of slots (40), each having an insertion hole (42) and a keyway (44). (FIGS. 2C–2D). Accordingly, the body (22) of the retaining belt (12) is provided with a plurality of holes (46) through which the pins (38) are provided. (FIGS. 2A, 2C and 2D). Once the pins (38) have been inserted therethrough, the back plate (36) is positioned over the pins (38) so that heads (48) pass into the insertion holes (42). Thereafter, the back plate (36) is slid laterally relative to the front plate (34) by moving the pins (38) along the keyways (44) thereby retaining the pins (38) against movement normal to the back plate (36) since the heads (48) of the pins (38) are wider than the keyways (44). In this manner, the front plate (34) and back plate (36) are secured to the retaining belt (12).

Alternatively, the front plate (34) and back plate (36) may be secured to the retaining belt (12) by adhesive, sewing or similar securement means. Also as shown in FIG. 2A, integrally molded with the front plate (34) is a first bracket (50) and second bracket (52). The brackets (50) and (52) are preferably provided with integrally molded pins (54).

As shown in FIG. 2A, the light assembly (32) is provided with a housing (56). The housing (56) is preferably provided with a pair of recesses (58) into which the pins (54) of the brackets (50) and (52) fit for journaled movement of the housing (56) relative to the brackets (50) and (52). (FIGS. 1, 2A and 2D). The pins (54) and recesses (58) are preferably constructed to generate sufficient friction to maintain the housing (56) against undesired movement when manually placed into a predetermined position.

Alternatively, the front plate (34) may be secured to the back plate (36) by a single pin (38), thereby allowing the front plate (34) to rotate relative to the back plate (36) without dislodging the two plates (34) and (36) from one another. In this manner, the cap illumination system (10) may be provided with an additional degree of rotation to allow the cap illumination system (10) to illuminate virtually any forward area.

As shown in FIG. 2A, the housing (56) includes a battery compartment (60) housing one or more "watch style" or AAA batteries (not shown), and a light emitting diode compartment (62) housing a light emitting diode (64), such as those known in the art to provide illumination. (FIGS. 1 and 2A).

As shown in FIG. 2A, secured to an exterior face (66) of the first flap (18) by adhesive, sewing or similar securement means is a switch (68) such as a touch sensitive switch, a manually operated mechanical switch, microswitch, or any other switch known in the art. Preferably, the switch (68) is a resistant touch switch wherein the resistance between two or more electrodes is reduced by the contact of skin or other conductive material. Alternatively, the switch may be a capacitance detection touch switch wherein the flesh acts as a capacitor grounded at one end. This switch can be used to detect contact or close proximity of flesh to the switch. In yet another alternative embodiment, the switch may be a conductive proximity touch switch. In such a switch, the proximity of flesh changes the inductive or capacitive coupling between two or more conductive regions, causing actuation of the switch. From the foregoing, it should be clear that "touch sensitive" covers any switching means in which flesh, or a heated element, in contact with, or in close proximity to, the switch causes actuation. As shown in FIG. 2A, the touch sensitive switch (68) is coupled to the light emitting diode (64) by a wire (70) or other conductive means.

When it is desired to use the cap illumination system (10) of the present invention, a cap (72) having an adjustment band (74) is provided. The cap (72) may be of the well known "baseball cap" variety. As shown in FIG. 1, 2A and 2B, to attach the cap illumination system (10) to the cap (72), the retaining belt (12) is provided around the adjustment band (74) with the second flap (20) folded in first and the first flap (18) folded thereover. This allows the first piece (26) of hook and latch material to coact with the second piece (30) of hook and latch material to retain the cap illumination system (10) in place, as shown in FIG. 2B.

Figure 3:
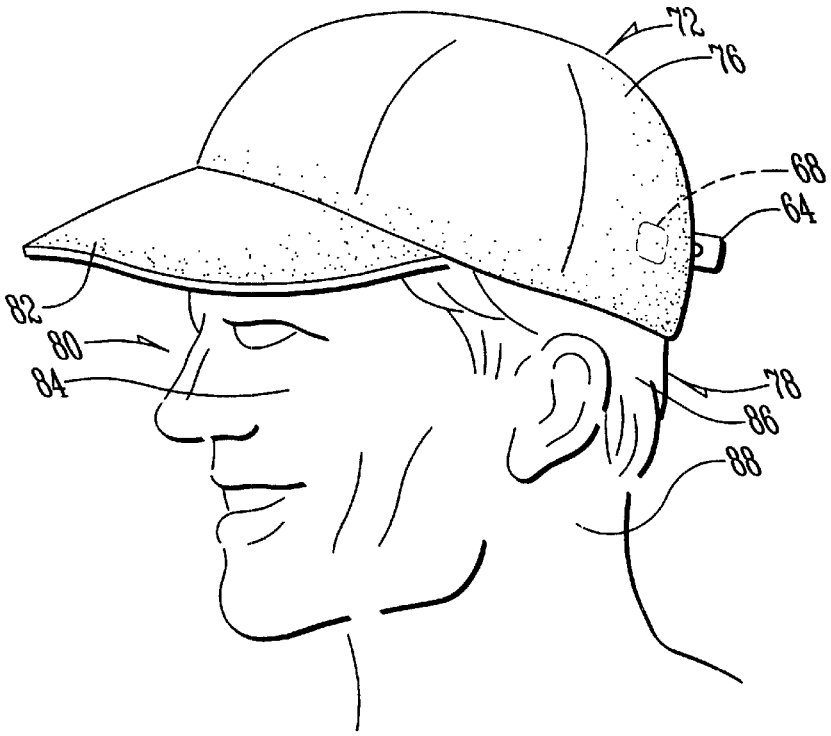
FIG. 3 illustrates a front perspective view of the baseball cap provided on a user.

As shown in FIGS. 1 and 3, when the cap (72) is worn in its standard orientation, the headpiece (76) is positioned over the head (78) of a user (80) with a visor (82) positioned over the face (84) of the user (80). In this orientation, the visor (82) shields the face (84) of the user (80) from sunlight (not shown) and the like the visor (82) is therefore a "light visor", shielding the user from various types of light which would otherwise strike the user's eyes. In this orientation, hair (86) of the user (80) insulates the touch sensitive switch (68) from the user's skin (88). Accordingly, in the standard orientation, the light emitting diode (64) is not actuated.

Figure 4:
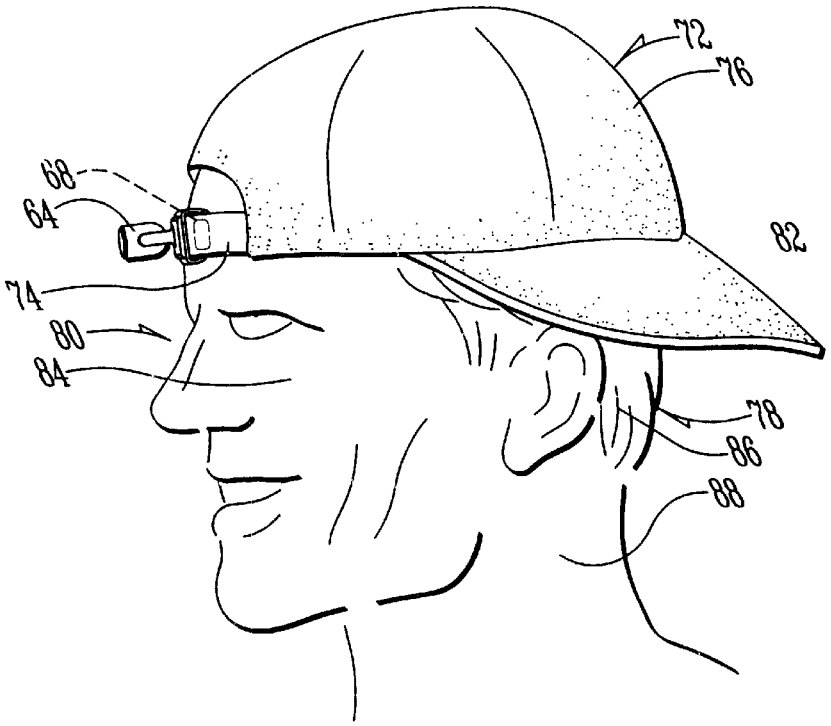
FIG. 4 illustrates a front perspective view of the baseball cap being reversed and secured to the head of a user with the light assembly directed forward.

At night, indoors, or any time additional illumination is desired, the cap (72) is removed and repositioned on the head (78) with the visor (82) facing toward the rear of the user (80). (FIGS. 1, 2A and 4). In this orientation, the touch sensitive switch (68) contacts the forehead (90) of the user (80), thereby actuating the light emitting diode (64) and illuminating an area in front of the user's face (84). As noted above, as the housing (56) is pivotally secured to the pins (54), the housing (56) may be adjusted to direct the light from the light emitting diode (64) up or down. Additionally, if the front plate (34) is connected to the back plate (36) by a single headed pin, the housing (56) may be rotated to provide an additional axis of rotation to more precisely direct illumination from the light emitting diode (64), preferably allowing the housing to rotate at least ninety degrees, more preferably, at least one hundred and eighty degrees and, most preferably, to illuminate along any angle forward of the adjustment band (74). (FIGS. 1, 2A, 2C, 2D and 4). In this manner, the light emitting diode (64) is automatically actuated by reversing the cap (72) on the user's head (78) in a manner which causes the touch sensitive switch (68) to contact the skin (88) of the user (80).

Figure 5:
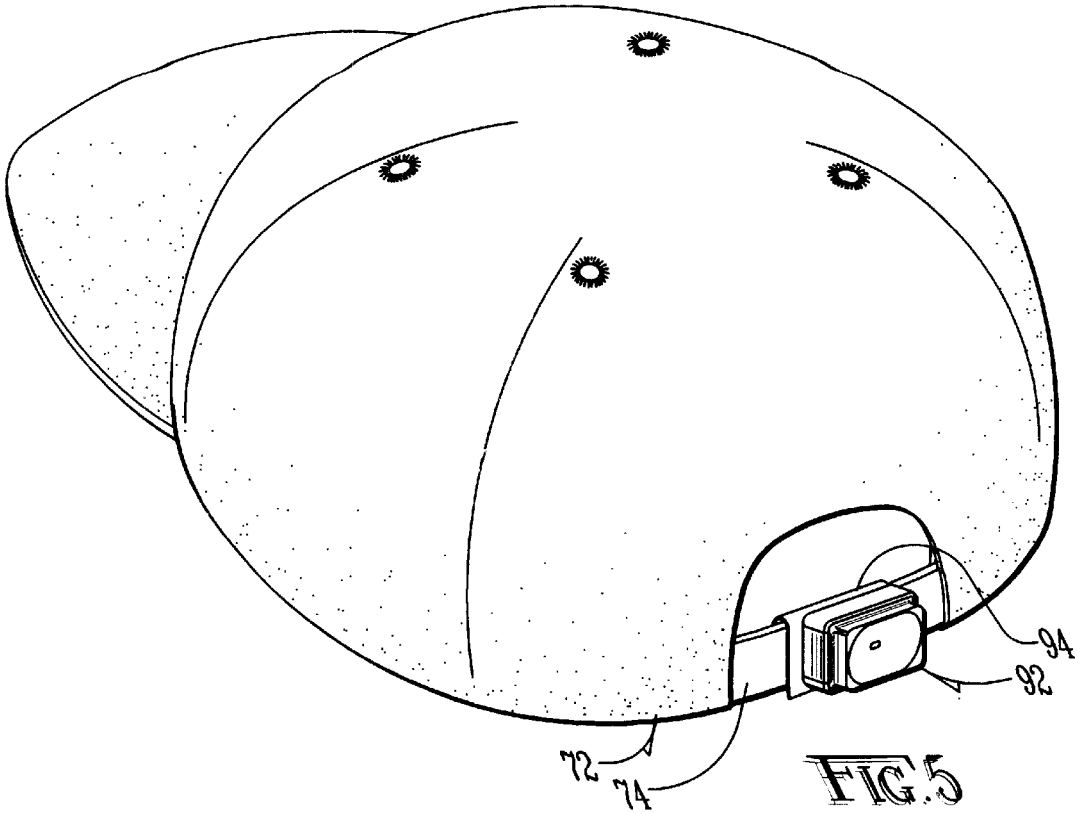
FIG. 5 illustrates a rear perspective view of an alternative embodiment of the present invention shown with a light assembly clipped to the adjustment band of a baseball cap.
Figure 6A:
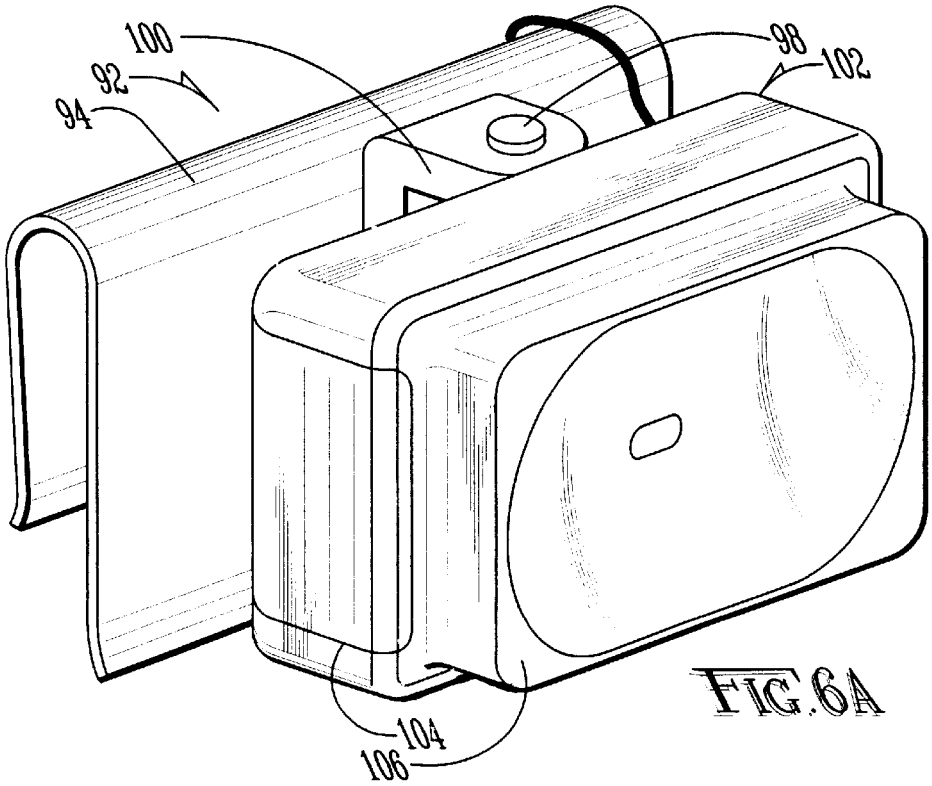
FIG. 6A illustrates a rear perspective view of the alternative light assembly of FIG. 5.
Figure 6B:
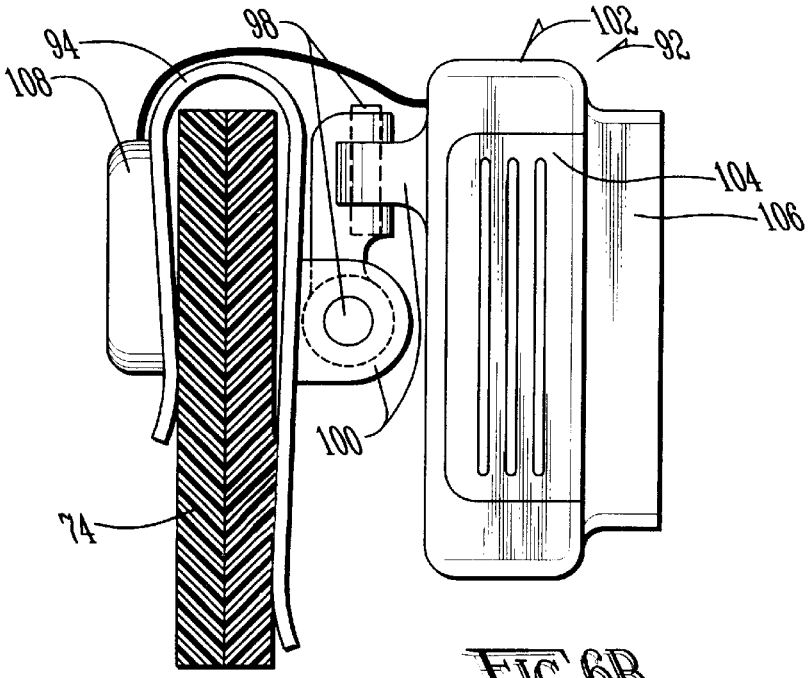
FIG. 6B illustrates a side elevation of the alternative light assembly of FIG. 5, showing the alternative light assembly clipped to an adjustment band.

FIG. 5 illustrates an alternative embodiment of the present invention in which an alternative cap illumination system (92) is clipped to the adjustment band (74) of the cap (72). As shown in FIG. 6A, the alternative cap illumination system (92) includes a resilient clip (94) constructed of spring steel or the like, although the clip (94) may be of any suitable dimensions, it is preferable that the clip (94) extend at least half-way down the adjustment band (74) when secured thereto. As shown in FIGS. 6A and 6B, secured to the clip (94) is a bracket having a pair of recesses (100). Journaled within the recesses (100) are a pair of pins (98). The pins (98) are on a housing (102) enclosing a battery (104) and a light emitting diode (106). Secured to an interior portion of the clip (94)is a touch sensitive switch (108) electrically coupled to the battery (104) and light emitting diode (106).

Accordingly, when it is desired to utilize the alternative cap illumination system (92), the clip (94) is forced over the adjustment band (74) of the cap (72) as the touch sensitive switch (108) is on the interior of the cap (72). When the cap is worn in the standard orientation, the light emitting diode (106) is not actuated until a user reverses the cap (72) and allows the touch sensitive switch (108) to contact the forehead (90) of a user (80). In this orientation, the user may rotate the bracket (96) and pivot the housing (102) within the bracket (96) to specifically direct illumination from the light emitting diode (106) to any desired location.

Figure 7:
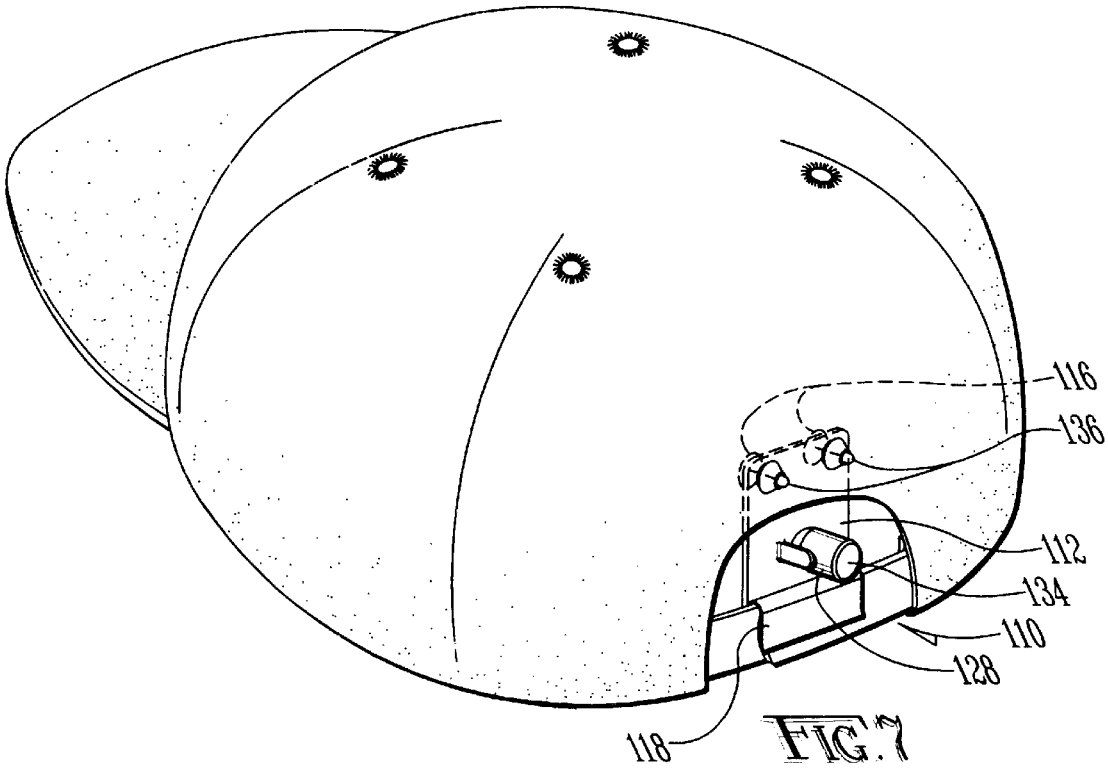
FIG. 7 illustrates a rear perspective view of yet another alternative embodiment of the light assembly of the present invention secured to a baseball cap.
Figure 8A:
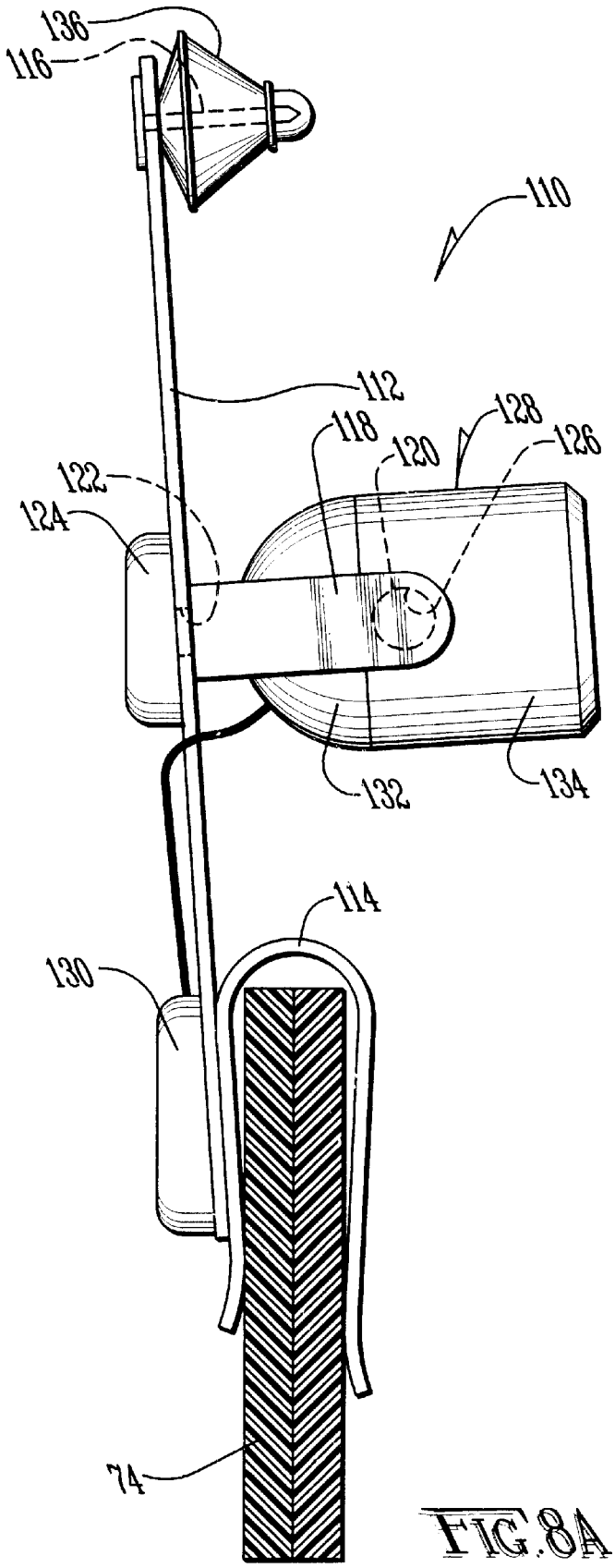
FIG. 8A illustrates a side elevation of the alternative light assembly of FIG. 7, shown with the light assembly secured to the cap and to the adjustment band provided thereon.
Figure 8B:
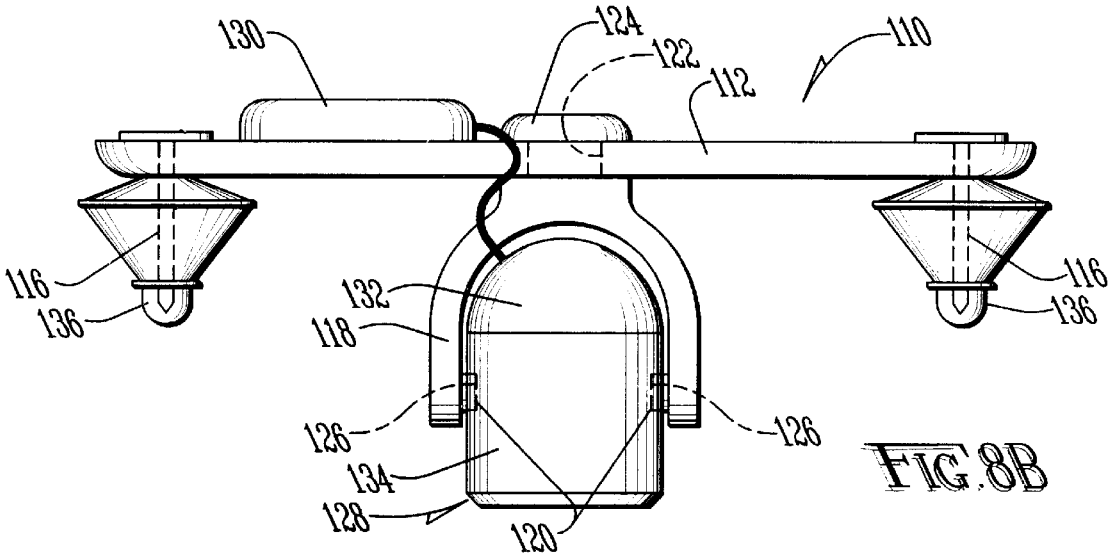
FIG. 8B illustrates a top elevation of the alternative light assembly of FIG. 7.

Shown in FIG. 7 is yet another alternative embodiment of the cap illumination system (110). As shown in FIG. 8A, the alternative cap illumination system (110) includes a resilient pad (112) constructed of woven textile or the like. Secured to the lower end of the pad (110) by adhesive or similar securement means is a bracket (114) constructed of steel or similarly rigid material. Also secured to the pad (112) are a pair of pins (116). A bracket (118) having a pair of side pins (120) is preferably constructed of nylon or similarly rigid material and provided through a hole (122) provided in the pad (112). The bracket (118) is preferably secured to the pad (112) by a head (124), which may be screwed, adhesively applied, or otherwise secured to the bracket (114).

Secured to the side pins (120) of the bracket (118) by indentations (126) is a housing (128) similar to that described above. Also, a touch sensitive switch (130) is secured to an interior portion of the pad (112) and electrically coupled to a battery (132) and light emitting diode (134) in a manner such as that described above. As shown in FIG. 7, when it is desired to utilize the alternative cap illumination system (110), bracket (114) is positioned over the adjustment band (74) and the upper portion of the pad (112) is positioned under the headpiece (76) with the pins (116) extending therethrough. Thereafter, a pair of caps (136) of the "tie tack" variety are secured over the pins (116) and secured thereto by indentation rings (not shown) provided on the pins (116).

The alternative cap illumination system (110) operates in a manner similar to that described above with the standard orientation of the cap allowing a user's hair (86) to prevent actuation of the light emitting diode (134), and reverse orientation causing skin to actuate the touch sensitive switch (130) and actuate the light emitting diode (134). This alternative cap illumination system (110) may be additionally modified with four pins (116) and caps (136) for use on a hat not having an adjustment band (74). In such an orientation, the light emitting diode (134) must be provided on the exterior of the hat and the touch sensitive switch (130) provided on the interior with the two being electrically coupled. In such a case, a hole is typically provided in the hat to allow connect coupling of the light emitting diode (134) to the touch sensitive switch (130).

Figure 9:
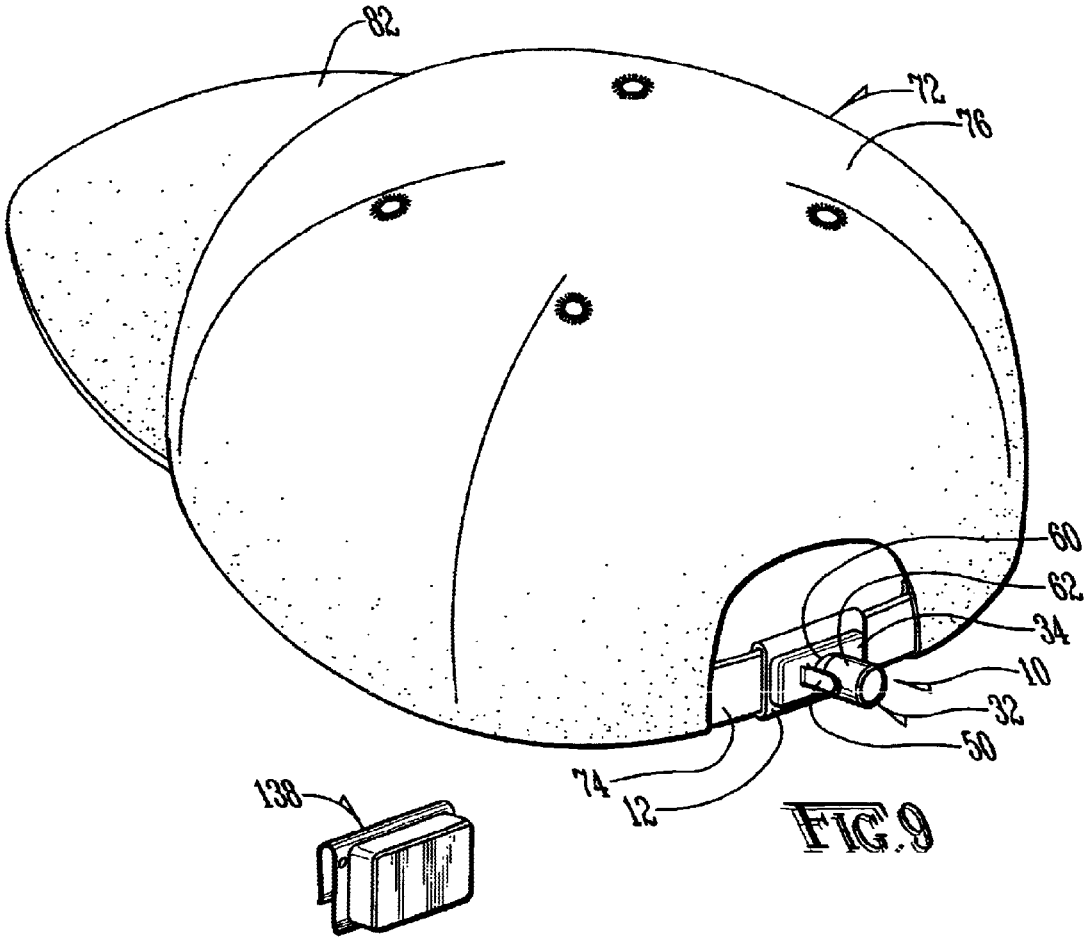
FIG. 9 illustrates a rear perspective view of an alternative embodiment of the present invention utilizing an alternative cap illumination system.

FIG. 9 illustrates an alternative embodiment of the present invention in which an alternative cap illumination system (138) is clippable to the adjustment band (74) and provided with both a light, such as that described above, and a supplemental light. The alternative cap illumination system (138) is designed to allow the light and the supplemental light to pivot independently of one another.

Although the invention has been described with respect to the preferred embodiment thereof, it is to be understood that is not to be so limited, since changes and modifications can be made therein which are within the full intended scope of this invention as defined by the appended claims. For example, it is anticipated that various types of incandescent and laser lights may be utilized in association with the present invention, as may a variety of switches and power sources. For example, it is anticipated that the visor (82) may be provided with a solar collector to recharge batteries for use in association with the light emitting diode.

What is claimed is:

1. An illumination system for a hat comprising:

(a) a light;

(b) means for securing said light to a hat;

(c) a touch sensitive switch coupled to said light;

(d) a power source coupled to said light;

(e) a head covering having a front and a rear;

(f) a light visor coupled to said front of said head covering; and (g) wherein said touch sensitive switch includes means for maintaining said light deactuated when said light visor extends forward from a user's head and for maintaining said light actuated when said light visor extends rearward from a user's head.

2. The illumination system for a hat of claim 1, further comprising means for allowing said light to pivot relative to a hat.

3. The illumination system for a hat of claim 1, further comprising an adjustment band coupled to said rear of said hat, wherein said means is means for securing said light to said adjustment band.

4. The illumination system for a hat of claim 3, further comprising means for allowing said light to pivot relative to said hat.

5. The illumination system for a hat of claim 1, further comprising a supplemental light and means for pivoting said light and said supplemental light independently of one another.

6. The illumination system for a hat of claim 1, further comprising means for allowing said light to alternately directly illuminate an area above the hat and an area below the hat.

* * * * *